US006142077A

United States Patent [19]

Coffey

[11] Patent Number: 6,142,077

[45] Date of Patent: Nov. 7, 2000

[54] PRINT MEDIA WITH UNTRIMMED PRINT GAPS

[75] Inventor: James B. Coffey, Englewood, Ohio

[73] Assignee: NCR Corporation, Dayton, Ohio

[21] Appl. No.: 09/365,061

[22] Filed: Jul. 30, 1999

[51] Int. Cl.[7] ..... B41F 1/54; G09G 5/22

[52] U.S. Cl. ..... 101/483; 101/226; 345/144

[58] Field of Search ..... 101/483, 62, 93.07, 101/226; 345/430, 434, 144; 235/494

[56] References Cited

U.S. PATENT DOCUMENTS

| | | | |
|---|---|---|---|
| 4,030,415 | 6/1977 | Fellows . | |
| 4,092,925 | 6/1978 | Fromson . | |
| 4,958,272 | 9/1990 | Wake . | |
| 5,416,312 | 5/1995 | Lamoure | 235/494 |
| 5,524,396 | 6/1996 | Lalvani | 52/81.1 |
| 5,602,943 | 2/1997 | Velito | 382/266 |
| 5,847,712 | 12/1998 | Salesin et al. | 345/430 |
| 5,850,262 | 12/1998 | Ibenthal et al. | 382/249 |
| 5,859,919 | 1/1999 | Holland et al. | 382/108 |
| 5,959,632 | 9/1999 | Hashimoto | 345/430 |
| 5,982,386 | 11/1999 | Fujimoto | 345/443 |
| 6,058,211 | 5/2000 | Borman et al. | 382/235 |
| 6,069,914 | 5/2000 | Cox | 380/5 |

*Primary Examiner*—Eugene Eickholt
*Attorney, Agent, or Firm*—Millen White Zelano & Branigan PC

[57] ABSTRACT

Printed products having a print gap and simulated full bleed borders or simulated full bleed backgrounds of a fractal design with a non-linear outer edge provide a visual effect of perfect edge alignment such that an additional allowance for trimming of the printed image is unnecessary.

25 Claims, 3 Drawing Sheets

PRINT MEDIA WITH UNTRIMMED PRINT GAPS

FIELD OF THE INVENTION

This invention relates to the printing of multiple forms with print gaps and gaps between forms, where the forms have a border or background of a design comprising a fractal graphic.

DESCRIPTION OF RELATED ART

Borders and backgrounds which provide coverage to the papers edge are referred to herein as "full bleed borders" and "full bleed backgrounds." Borders and backgrounds which simulate coverage to the papers edge are referred to herein as "simulated full bleed borders" and "simulated full bleed backgrounds." Borders and backgrounds are often desirable for printed forms such as business forms, place mats, etc. The graphics which define these borders and backgrounds are typically aligned with the edge of the paper sheet of the printed form when finished. In many printing processes, such as standard lithographic offset printing processes, a print gap is a necessary part of the printed image. In addition, where multiple images are printed at one time, a gap typically exists between them to account for distortions during the pressing operation. In standard lithographic processes, the printing gap is formed due to the plate cylinder used in the lithographic press. The plates typically comprise inexpensive aluminum, as described in U.S. Pat. No. 4,092,925, that are processed in the flat and then wrapped around a plate cylinder and locked in place. Wrapping of the print plates typically forms print gaps in the range of ⅛" to ⅔" with gaps in the range of ¼" to ½" being very common. Gaps between the images of a multiple image print are often the same as the print gap to simplify trimming.

The print gap is typically located at the top or bottom of the printed product but can be located on the sides of the product as well. Where a print gap is present on the printed product, border or background printing requires either extra trimming to remove the gaps or a separate print unit is used to print within the gaps by a second printing. Both techniques have disadvantages.

Removing gaps in the printed product by secondary trimming operations adds to the cost of finishing the printed forms and also produces wasteful scraps. Using two separate units to print within the gaps is difficult in that overlap between the two printings can occur where the images join. This problem becomes more apparent when all of the factors that contribute to distortions during pressing operations which can lead to overlap are considered. Overlap is difficult to control and where it does occur, secondary trimming may be necessary to remove the overlap. Modern software and digital control have eliminated most of the pre-press errors in preparing printing plates used in standard lithographic presses and have significantly improved the control over the dimensional variations of lithographic printing processes. However, these techniques do not provide control over all variables such as roll-out between the plate and blanket, expansion and contraction of paper, paper tension and skewing of the print plate. Exact dimensional control is required to produce borders and backgrounds without overlap or the need for secondary trimming.

Fractal objects are defined as self-similar objects having the same shape on both a small and large scale. This means that when such objects are magnified, their parts are seen to bear a resemblance to the whole, the likeness continuing with parts of the parts. Fractal objects can be 2-dimensional or 3-dimensional. Fractals are described mathematically and have been used in a variety of applications, such as: data compression, digital half-toning (See U.S. Pat. No. 4,958,272), computer animation, engineering modeling, mapping, etc. Fractal graphics are based on repetition (self-similarity) of a graphic element which follows a definite pattern. Mathematical models define the fractal graphics which are generated with the aid of a computer. Fractal generated graphics are well known in the art and software which generate fractal graphics is commercially available as is software which designs and controls borders and full backgrounds to be printed by various printing methods.

SUMMARY OF THE INVENTION

The invention provides printed base sheets of multiple forms and finished single forms obtained therefrom. The base sheets of multiple forms have at least one gap between forms, such as from a standard lithographic offset printing press, which need not be trimmed, thus reducing secondary trimming operations and scrap. Multiple printed forms such as place mats and letterheads are finished without the need to remove gaps between the forms.

The forms have a full bleed border, a full bleed background, a simulated full bleed border or a simulated full bleed background which comprises a fractal graphic with a non-linear outer edge. This fractal graphic provides a visual effect of perfect alignment between the edge of the forms and the full bleed border, full bleed background, simulated full bleed border or simulated full bleed background.

The full bleed borders and full bleed backgrounds additionally comprise full bleed non-fractal graphics.

The invention includes printed single forms comprising a paper sheet having a full bleed border, full bleed background, simulated full bleed border or simulated full bleed background comprised of a fractal graphic which is misaligned with one or more edges of the paper sheet by an amount ranging from above 0% of the gap between forms to 90% of the gap between forms. These printed single forms are obtained from a base sheet of multiple forms with at least one gap between forms.

The invention further includes printed products having a full bleed border, full bleed background, simulated full bleed border or simulated full bleed background comprised of a fractal graphic wherein the fractal graphic design is digitally designed and preferably compensates to correct variables inherent in printing process and printing equipment such as: expansion and contraction of the printing medium, register between the print units, plate wrap-up (skew), print medium tension, and distortion created by a plate roll-out.

This invention also provides a process for preparing single forms with a border or background comprising a fractal graphic. This method comprises printing a base sheet of multiple forms by a lithographic printing process with at least one gap between forms, each form having a border or background comprising a fractal graphic which does not have a linear outer edge. Single forms can be cut from the base sheet without trimming the gaps between forms. Alternatively, the base sheet may be printed on again to fill the gaps and the single forms may be cut from the base sheet without trimming between the forms.

The fractal graphic preferably comprises a fractal graphic primitive which is reproduced in a contiguous pattern by joining the fractal graphic primitive either head to foot, foot to head or head to head/foot to foot. This fractal graphic primitive is arranged in a manner so as not to form a linear outer edge. The process may also include the additional step of digitally compensating the fractal graphic to correct variables in printing by adjusting the size of fractal graphic primitive and/or the number of reproductions of said fractal graphic primitive.

It has been discovered that fractal designs used in borders and backgrounds create a visual effect of perfect edge alignment where the graphic provides a non-linear outer edge. Single sheets derived from base sheets of multiple forms printed with at least one gap between forms need not be trimmed between forms to provide a finished form due to this visual effect. Finished printed forms with a print gap of ⅛" to ⅔" can be obtained by standard lithography offset printing without allowances for additional trimming. In preferred embodiments, the gaps between forms are less than ½". A non-linear edge is needed on the fractal graphic so that the naked human eye does not detect misalignment of the border or background with the edge of the paper sheet. The borders or backgrounds can be misaligned by an amount, X, in the range of $0\%<X<90\%$ of the gap between forms.

A mathematical model is used to form an initial graphic design, referred to herein as a fractal graphic primitive or element. After generation of the fractal primitive, a pattern is formed wherein the basic primitive or elemental part of the design is continuously reproduced in a contiguous pattern by joining head to foot, foot to head or head to head/foot to foot. This basic process of forming a fractal primitive followed by repetition of this graphic in a contiguous pattern is used to design the graphic pattern for the borders or backgrounds of the printed forms provided by this invention. In following this procedure, the design can be adjusted at the primitive or elemental part of the design when needed in order to provide and maintain a precise and predictable model, especially when printing multiple forms two or three wide in a stream. In preferred embodiments, the model is first used to prepare the fractal graphic primitive and the dimensions of the fractal graphic primitive is adjusted in dimension and/or configuration to compensate for the distortion anticipated by the lithographic printing process. This includes distortions created by expansion and contraction of printing medium, register between the print units, plate wrap-up (skew), print medium tension, and distortion created by plate roll-out. Therefore, finished printed designs are more precisely controlled.

The fractal primitives can be those known in the art or digitally designed by conventional software. Any 2D or 3D graphic primitive or element or mixture thereof that is joined head to foot, foot to head, or head to head/foot to foot used as part the design will maintain the integrity of the basic model structure.

Conventional software such as vector type computer software (i.e., AutoCad) will permit the development of any type of model structure or pattern desired with the graphic primitive. With such software a precise design pattern can be produced that will fit the exact printing requirements for any given print circumference required for the border or background. After establishment of the print gap requirement for a given circumference and other gaps between forms, the location for the print gap relative to the printed pattern being printed on the finished form must be established. This is typically at the top or bottom of the form; however, the gap can be placed at any convenient location. Once the size and location of the print gap and other gaps have been established, the exact border or background can be designed.

The full bleed borders and full bleed backgrounds comprise a non-fractal graphic which extends to the edge of single forms and to the cut lines of the multiple forms. These non-fractal graphics are typically formed by multiple printing steps to print within the gaps of the first printing. The simulated full bleed borders and simulated full bleed backgrounds may optionally include a non-fractal graphic, provided it does not form a linear edge on the borders and backgrounds.

Figure 1:
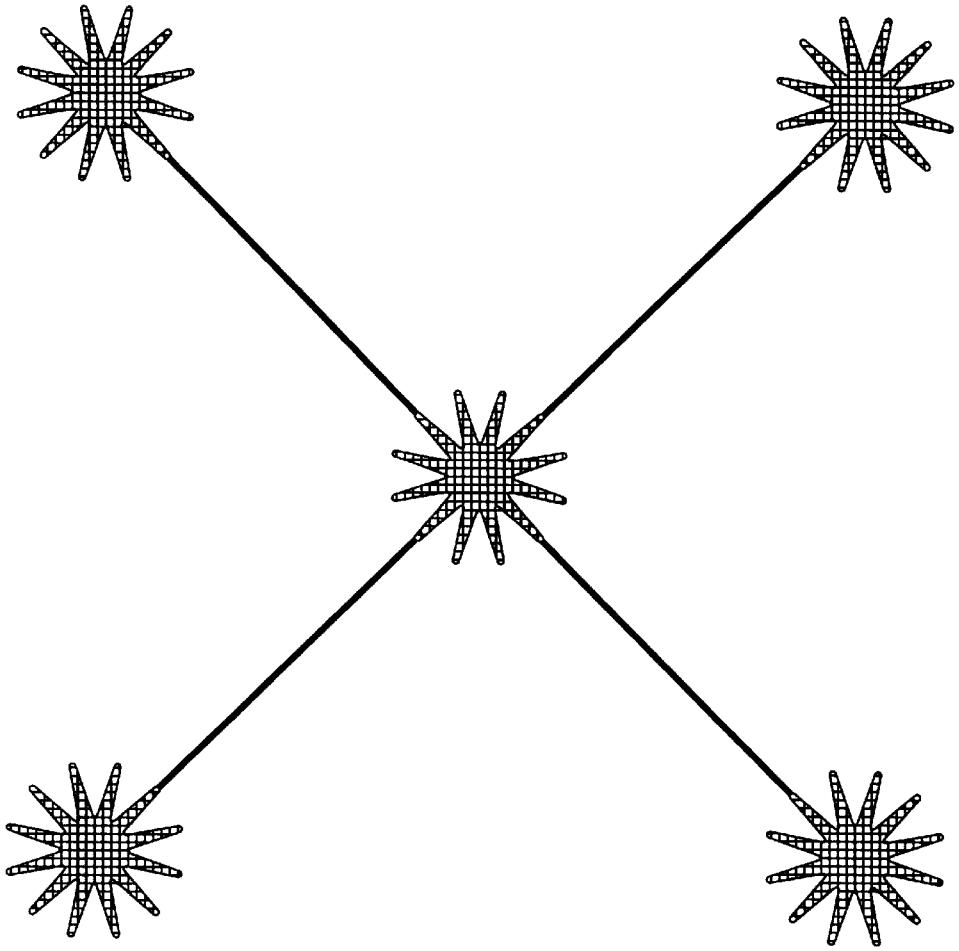
FIG. 1 shows a fractal graphic primitive.
Figure 2:
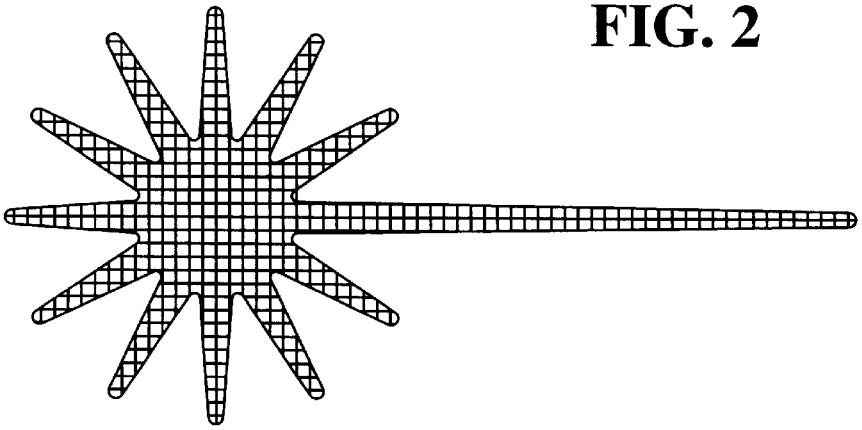
FIG. 2 shows a graphic element of the fractal graphic primitive of FIG. 1.

A sample model structure of a fractal graphic primitive is shown in FIG. 1. This primitive has a repeating element shown in FIG. 2. This primitive can be generated and controlled using conventional software.

Figure 3:
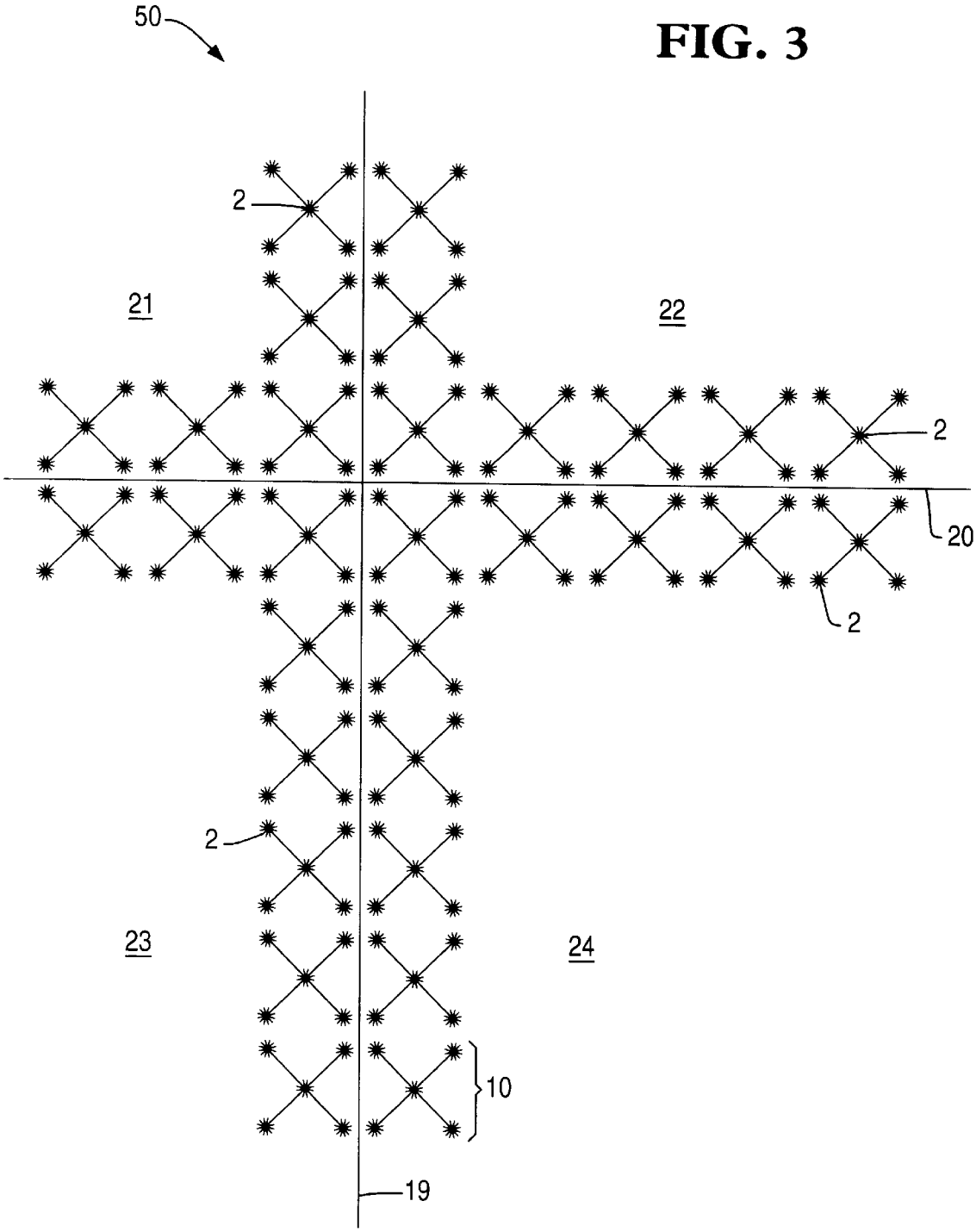
FIG. 3 shows an enlarged portion of four adjacent uncut printed forms having borders of fractal design with the cut lines indicated.

Referring to FIG. 3, an enlarged portion of a two-wide printing 50 of simulated full bleed borders of four adjacent forms 21, 22, 23 and 24 is shown. The simulated full bleed borders 2 contain graphical design primitives 10 of the basic fractal primitive shown in FIG. 1. Two intersecting cut lines 19 and 20 divide the four adjacent forms and are optional. They are shown here to represent the position where the forms are cut and separated. With the use of the fractal graphic, trimming each form to the edge of the fractal graphic is not necessary and waste is eliminated.

Figure 4:
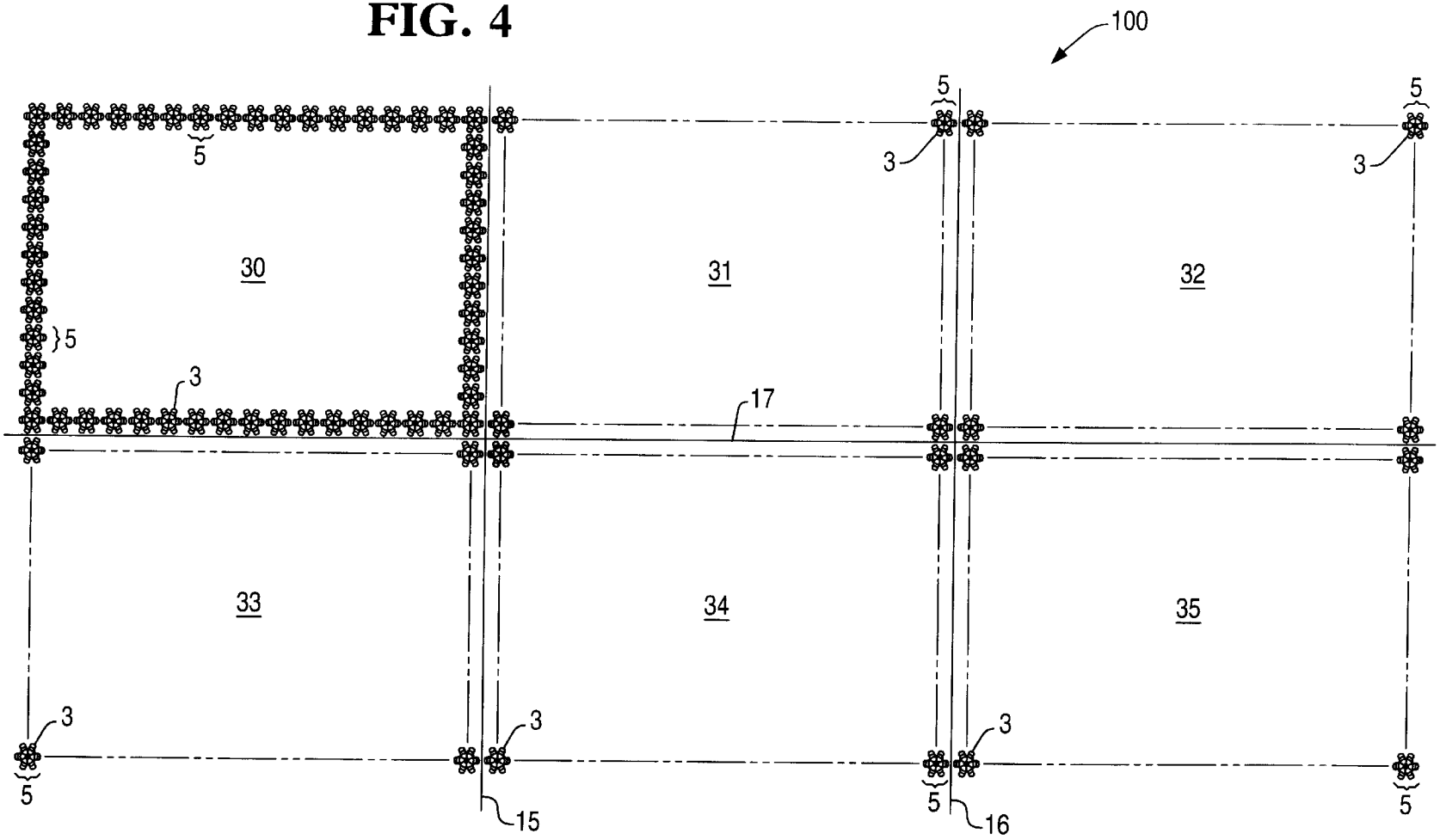
FIG. 4 shows a sample of a two-wide printing having borders of fractal design with cut lines indicated.

FIG. 4 shows a sample of a two-wide printed base sheet 100 of multiple forms 30, 31, 32, 33, 34 and 35 having simulated full bleed borders 3 of a fractal graphic design comprising fractal graphic primitive 5. Cut lines 15, 16 and 17 are optional.

Without further elaboration, it is believed that one skilled in the art can, using the preceding description, utilize the present invention to its fullest extent. While the invention has been particularly shown and described with reference to preferred embodiments thereof, it will be understood by those skilled in the art that various changes in form and details may be made therein without departing from the spirit and scope of the invention.

What is claimed is:

1. A finished printed single form comprising a paper sheet with a border or background which is printed as a base sheet of multiple forms with at least one gap between forms, wherein said printed single form is cut from said base sheet of multiple forms without trimming of the gaps between forms, wherein said border or background comprises a fractal graphic with a non-linear outer edge and optionally a non-fractal full bleed graphic with a non-linear outer edge.

2. A finished printed single form as in claim 1 wherein the border is a full bleed border or a simulated full bleed border and the background is a full bleed background or a simulated full bleed background printed on said base sheet of multiple forms with a standard lithographic offset printing press, said base sheet of multiple forms has at least one print gap between forms of a size in the range of ⅛" to ⅔" and said full bleed border or full bleed background comprises both a fractal graphic and a non-fractal full bleed graphic with a non-linear outer edge.

3. A finished printed single form as in claim 2 which contains more than one gap between forms of a size in the range of ¼" to ½".

4. A finished printed single form as in claim 2 wherein the simulated full bleed border, simulated full bleed background, full bleed border or full bleed background is misaligned with one or more edges of said paper sheet by an amount ranging from 10% to 90% of the widest print gap between forms and the fractal graphic provides a visual effect of perfect edge alignment with the paper sheet such that the misalignment of the simulated full bleed border, simulated full bleed background, full bleed border or full bleed background with one or more edges of the paper sheet is undetectable by the naked human eye.

5. A printed base paper sheet with multiple forms, each form having a full bleed border, a full bleed background, a simulated full bleed border or a simulated full bleed background, said base paper sheet having at least one print gap of a size in the range of ⅛" to ⅔", wherein said simulated full bleed border or simulated full bleed background comprises a fractal graphic with a non-linear outer edge that provides a visual effect of perfect edge alignment when the base sheet of multiple forms is cut into separate forms along the edges of said simulated full bleed border or simulated full bleed background, and wherein full bleed border or full bleed background comprises a non-fractal full bleed graphic and a fractal graphic with a non-linear outer edge that provides a visual effect of perfect edge alignment when the base sheet of multiple forms is cut into separate forms along the edges of said full bleed border or full bleed background.

6. A printed base paper sheet of multiple forms as in claim 5, which is printed with a standard lithographic offset printing press.

7. A printed base paper sheet as in claim 6 of 4 to 10 forms with a gap of a size in the range of ¼" to ½" between each form.

8. A finished printed single form comprising a paper sheet with a full bleed border, a full bleed background, a simulated full bleed border or a simulated full bleed background which is cut from a base paper sheet of multiple forms of claim 5 without trimming off the gaps between each form.

9. A finished printed single form as in claim 8, wherein the full bleed border, full bleed background, simulated full bleed border or simulated full bleed background is misaligned with at least one edge of the paper sheet by an amount ranging from 10 to 90% of the print gap and the fractal design provides a visual effect of perfect alignment of the border or background with the edges of the paper sheet such that misalignment of the full bleed border, full bleed background, simulated full bleed border or simulated full bleed background with the edges of the paper sheet is undetected by the naked human eye.

10. A finished printed single form as in claim 1, wherein the fractal graphic is digitally designed.

11. A printed base paper sheet with multiple forms as in claim 5, wherein the fractal graphic is digitally designed.

12. A finished printed single form as in claim 8, wherein the fractal graphic is digitally designed.

13. A printed base paper sheet with multiple forms as in claim 9, wherein the fractal graphic is digitally designed.

14. A finished printed single form as in claim 10, wherein said fractal graphic is digitally compensated to correct variables in printing selected from the group consisting of expansion and contraction of the sheet substrate, register between the print units, plate wrap-up, print medium tension and distortion of the print medium created by a plate roll out.

15. A printed base paper sheet as in claim 11, wherein said fractal graphic is digitally compensated to correct variables in printing selected from the group consisting of expansion and contracting of the printing medium, register between the print units, plate wrap-up, print medium tension and print medium distortion created by a plate roll out.

16. A finished printed single form as in claim 12, wherein said fractal graphic is digitally compensated to correct variables in printing selected from the group consisting of expansion and contraction of the sheet substrate, register between the print units, plate wrap-up, print medium tension and distortion of the print medium created by a plate roll out.

17. A printed base paper sheet as in claim 13, wherein said fractal graphic is digitally compensated to correct variables in printing selected from the group consisting of expansion and contracting of the printing medium, register between the print units, plate wrap-up, print medium tension and print medium distortion created by a plate roll out.

18. A printed base paper sheet as in claim 5 having cut lines.

19. A finished printed single form comprising a paper sheet with a simulated full bleed border or a simulated full bleed background which is printed as base sheet of multiple forms with at least one print gap, wherein said printed single form is cut from said base sheet of multiple forms without trimming off the print gaps between forms and wherein said simulated full bleed border or simulated full bleed background comprises a fractal graphic with a non-linear outer edge.

20. A finished printed single form as in claim 1 wherein the simulated full bleed border or simulated full bleed background additionally comprises non-fractal graphics printed on said base sheet of multiple forms.

21. A process for preparing single forms with a border or background comprising a fractal graphic, said method comprising a) printing a base sheet of multiple forms by a lithographic printing process with at least one gap between forms, each form having a border or background comprising a fractal graphic which does not have a linear outer edge, and b) cutting single forms from the base sheet without trimming the gaps between forms.

22. A method as in claim 21 comprising the additional step of printing on wherein the base sheet again to fill the gaps between forms before the single forms are cut from the base.

23. A method as in claim 21 comprising the additional step of preparing the fractal graphic by forming a fractal graphic primitive and reproducing the fractal graphic primitive in a contiguous pattern by joining the fractal graphic primitive either head to foot, foot to head or head to head/foot to foot in a manner so as not to form a linear outer edge.

24. A method as in claim 23 comprising the additional step of digitally compensating the fractal graphic to correct variables in printing by adjusting the size of fractal graphic primitive and the number of reproductions of said fractal graphic primitive.

25. A finished printed single form comprising a paper sheet with border or background comprising a fractal graphic with a non-linear outer edge, wherein said printed single form is printed as a base sheet of multiple forms with at least one gap between forms and is cut from said base sheet of multiple forms without trimming of the gaps between forms.

* * * * *